United States Patent [19]

Saltsman

[11] Patent Number: 4,817,302

[45] Date of Patent: Apr. 4, 1989

[54] SANDAL CONSTRUCTION WITH IMPROVED STRAP ADJUSTMENT

[76] Inventor: Stephen B. Saltsman, 2344 County Rd. 225, Durango, Colo. 81301

[21] Appl. No.: 183,002

[22] Filed: Apr. 18, 1988

[51] Int. Cl.[4] ..... A43B 3/12

[52] U.S. Cl. ..... 36/11.5

[58] Field of Search ..... 36/11.5; 12/142 S

[56] References Cited

U.S. PATENT DOCUMENTS

| | | | |
|---|---|---|---|
| 2,451,372 | 10/1948 | Ballenger | 36/11.5 |
| 2,642,677 | 6/1953 | Yates | 36/11.5 |
| 3,228,124 | 1/1966 | Schwarz | 36/11.5 |
| 3,275,002 | 9/1966 | Scholl | 36/11.5 |
| 4,200,997 | 5/1980 | Scheinhaus et al. | 36/11.5 |
| 4,300,294 | 11/1981 | Riecken | 36/11.5 |
| 4,446,633 | 5/1984 | Scheinhaus | 36/11.5 |

FOREIGN PATENT DOCUMENTS

| | | | |
|---|---|---|---|
| 1947245 | 3/1971 | Fed. Rep. of Germany | 36/11.5 |
| 750312 | 8/1933 | France | 36/11.5 |

*Primary Examiner*—Donald Watkins

*Attorney, Agent, or Firm*—Kenton L. Freudenberg; Maxwell C. Freudenberg

[57] ABSTRACT

An improved construction of sandal type footwear wherein adjustment of a continuous foot retention strap within the sole of the sandal is attained by incorporating a porous, disintegrable or partial adhesive barrier which allows assembly of the sandal without permanently fixing the strap into position, and an adhesive which allows readherence of the straps after they have been adjusted so as to prevent undesirable slippage of the straps through the sole assembly.

20 Claims, 2 Drawing Sheets

SANDAL CONSTRUCTION WITH IMPROVED STRAP ADJUSTMENT

The present invention relates to an improved construction of sandal-type footwear incorporating continuous webbing for the purpose of holding the foot in position on the sandal's sole in which such webbing is adjustable through the sole of the sandal and incorporates a disintegrable adhesive barrier which allows assembly of the sandal without permanently fixing the straps into position.

BACKGROUND OF THE INVENTION

There is a nearly unlimited quantity of designs of sandals employing a correspondingly wide variety of configurations of retention straps and means for adjustability to a wearer's foot.

Adjustability has commonly been achieved using laces or straps which are made adjustable by tying or by the incorporation of fasteners such as buckles, or hook-and-loop fasteners to allow varying the length of the straps or laces around the wearer's foot. Some designs, such as that shown in Scheinhaus et al, U.S. Pat. No. 4,200,997, have included a means of adjustability in which the securing straps pass freely through passages within the sole assembly of the sandal. A problem in this previous construction, where the webbing is continuous and freely adjustable is that the straps had a tendency to move readily relative to the sole assembly when the sandal was worn, causing some portions of the strap to loosen while other portions of the strap would tighten around the wearer's foot. This problem is common where the foot retention straps are subject to the uneven forces resulting from walking on uneven surfaces such as going up or down an incline and where these forces tend to cause the foot to move towards one side or one end of the sandal sole. This slippage of the straps where they pass through the sole assembly causes a poor retention of the foot and discomfort to the wearer.

Such a construction also has the disadvantage of adding unnecessary thickness and irregularities to the sole of the sandal under the wearers's foot due to the extra thickness of the tubing used to surround the strap where the strap passes through the sole of the sandal.

At the other extreme, straps fixed permanently in place would not allow adjustment of the various portions of the strap to the individual anatomy of a wearer's foot without having multiple buckles or other methods of adjustment. Such a construction presents the disadvantages of the straps not presenting a smooth surface against the wearer's foot and requiring numerous points and means of adjustment in order to achieve a good fit of the sandal on the wearer's foot.

With the growing popularity of outdoor recreation such as river-running in the desert canyons of the western United States where sandal type footwear is commonly used for its quick drying ability and where the same footwear may be used for hiking in rugged, uneven and hilly terrain along a river, it is desirable to use a sandal incorporating the features of the present invention.

SUMMARY OF THE INVENTION

The present invention provides for a construction of sandal in which the retention straps are adjustable through the sole yet will tend to become secured in place as the sandals are worn, allowing a semi-permanent fit of the sandal to be achieved after an initial wear-in period. The semipermanence of the fit is due to the fact that, once "set," the straps can only be moved by the application of a significant force to break them free but are not subject to movement when being worn.

It is therefore a object of the present invention to provide a sandal construction incorporating an adhesive barrier surrounding the retention straps where they pass through the sole which contributes no perceptible thickness to the sole of the sandal, notwithstanding the uniform thickness of multiple laminations or sole members which make up the sole assembly.

It is a further object to provide a method of sandal construction which allows a wearer to individually adjust a pair of sandals with such sandals "setting" to a generally permanent fit with continued use.

It is another object of the invention to achieve a construction of sandal which allows adjustability of a single strap attachment means without allowing excessive and undesirable tightening and/or loosening of different foot-gripping portions of the strap when the sandal is being used.

It is another object of the present invention to achieve a construction of sandal in which the adjustable straps are secured by passing under a mid-sole of a relatively more durable material than the other laminations of the sole assembly to provide increased lateral stiffness and resistance to any tearing of sole laminations by the forces on the straps.

DESCRIPTION OF THE PREFERRED EMBODIMENT

Figure 2:
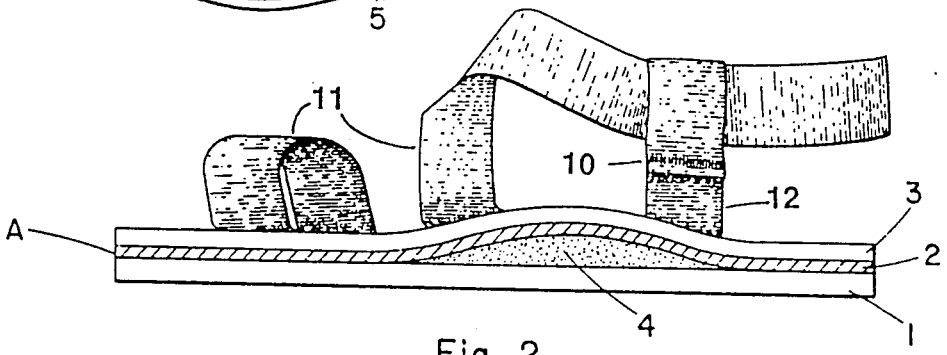
FIG. 2 is a side view of the elements comprising the sole assembly of the sandal.
Figure 4:
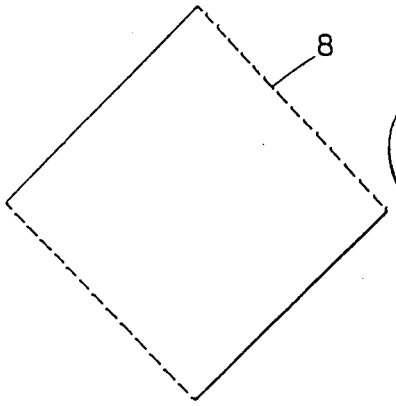
FIG. 4 is an illustration of the shape of the tissue paper used in the preferred embodiment prior to its being folded and positioned to serve as an adhesive barrier by surrounding the crossed portions of the main retention strap where they pass below the midsole of the preferred embodiment.

The sandal sole assembly shown in FIG. 2 is comprised of four components, a lower sole 1, a midsole 2, an upper sole 3 and an arch support 4. The lower sole 1 may consist of 16 iron (1 iron 1/48 inch) crinkle crepe synthetic rubber material such as that available from the Cats Paw Rubber Company of Waltham Mass. as "3406 Black Nulite." The material of the upper sole 3 is identical to that of the lower sole but is of a thinner 12 iron thickness. The midsole 2 is also made from a synthetic rubber compound which has additional reinforcing filler material so as to be stiffer and stronger than the material used for the upper and lower soles. Such a midsole material is sold by Cats Paw as "1158 natural midsoling." A 4 or 6 iron thickness has been found to provide a desirable degree of stiffness and durability. The sole members 1, 2 and 3 are of uniform thickness throughout their extent prior to assembly.

The materials of the upper sole 3 and midsole 2 are bonded together in sheets using a suitable waterproof adhesive such as that sold as "Dural Contact Cement" by the Dural Co., Inc. of Milwaukee, Wis. 53218. From these sheets the sole shape can be cut using a die cutting process which simultaneously perforates this composite lamination to form the apertures or slots 5 and 6 in the composite upper sole 3 and midsole 2 through which the main or front retention strap 11 and rear retention strap 12, respectively, will pass. The ends of the front retention strap 11 and rear retention strap 12 are then inserted through slots 5 and 6.

The slots 5 are at the corners of a quadrilateral, the area of which covers the location of the ball of the foot and is a principal weight-supporting area of the sole assembly. Two of the slots 5 are at opposite sides of the sole at the forward part thereof and the other two slots 5 are at opposite sides near the center of the sole. The location of the forward pair of slots 5 locates the toe loop of the main strap 11 so that it extends outwardly and rearwardly at an angle of approximately 72° with respect to the vertical toe-to-heel centerplane of the sandal.

Figure 1:
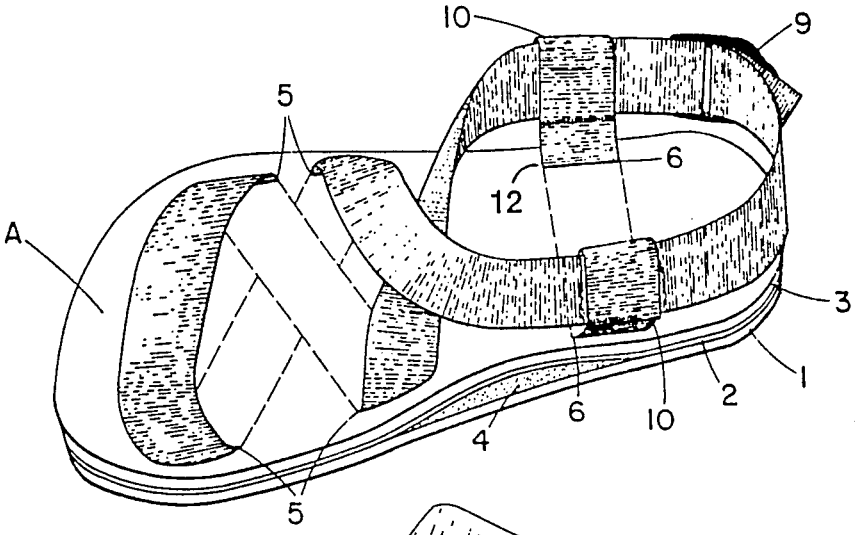
FIG. 1 is a perspective view of the preferred embodiment showing in dotted lines the configuration of the portions of the retention straps within the sole of the sandal.
Figure 3:
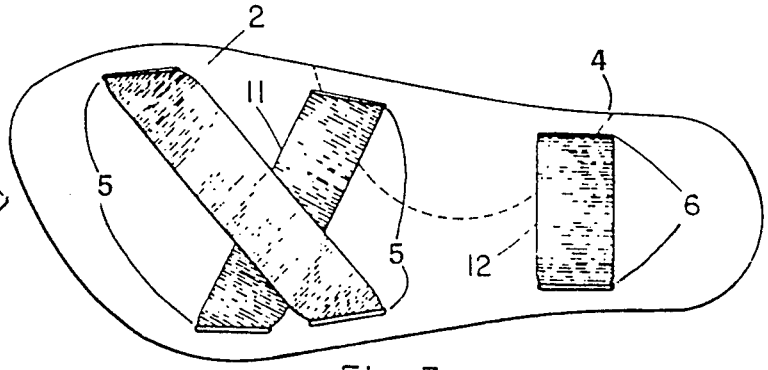
FIG. 3 is a view of a partially assembled sandal showing the bottom surface of the midsole and the orientation of the retention straps at the interface between the midsole and the lower sole.

The ends of the front retention strap 11 are inserted through the forward pair of slots 5 with first portions extending downwardly through these slots and then second portions of the strap 11 are crossed beneath the midsole 2 and extended upwardly through the rearward pair of slots 5 in the upper sole 3 and midsole 2 to achieve the wrapping pattern as shown in FIGS. 1 and 3. A square adhesive barrier 10 is then placed over the crossed portions of the front retention strap 11 and the corners are tucked between the strap and midsole so that the adhesive barrier primarily covers and generally conforms to the configuration of the exposed crossed portions of the retention strap 11 while leaving the majority of the surface of the midsole 2 free to be coated with adhesive.

Figure 5:
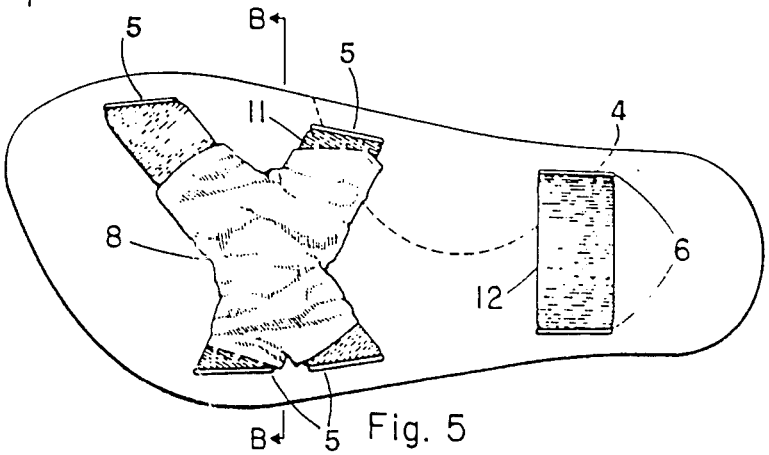
FIG. 5 is a view identical to that in FIG. 3 further showing the placement of the tissue paper of FIG. 4 as an adhesive barrier around the crossed portions of the main retention strap within the sole assembly.
Figure 6:
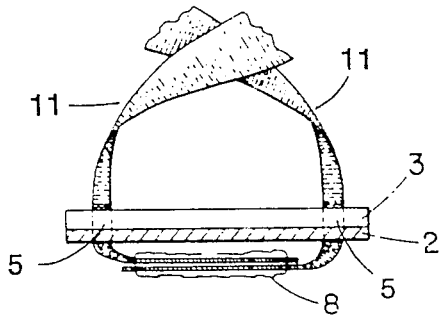
FIG. 6 is a cross section as taken at line B—B in FIG. 5 showing the relative orientations of retention strap 11 where it passes through the upper sole 3 and midsole 2 and is surrounded by the tissue paper 8 prior to the attachment of the lower sole.

To achieve the purposes of the invention the adhesive barrier can be comprised of ordinary tissue paper, preferably single ply, which has the qualities of being porous and fragile so as to not present a permanent impervious barrier to the adhesive. The barrier may be selected to permit partial penetration of the adhesive therethrough. Another advantage of using tissue paper is that sheets of the most commonly available rolls of such paper are essentially square and of a suitable size for use in wrapping around the crossed portions of strap member 11 as seen in FIG. 5. Once in place, such a tissue paper has a tendency to at least partially disintegrate upon movement of the retention strap after assembly of the sandal. This allows increased contact of the strap with the adhesive and increased adhesion between the strap and the adjacent laminations or sole members.

The adhesive used is any suitable "contact" adhesive. This type of adhesive has the benefit of retaining a slight degree of tackiness so that where a weak bond has been broken such as in the area containing the adhesive barrier, continued pressure such as that resulting from the weight of the sandal wearer has a tendency to cause readherence of the adhesive so as to prevent any undesirable movement of the front retention strap. This undesirable movement can occur where the strap is subject to the uneven forces caused by the wearer running or walking on an uneven surface such as up or down an incline, particularly when hiking under the aforementioned rugged conditions.

The extra stiffness and resistance to tearing of the midsole 2 serve to provide a more secure means of anchoring the retention straps 11 and 12 within the sole assembly of the sandal.

The end portions of the main retention strap 10 which rise from the centrally located slots 5 cross each other above the wearer's instep and are of sufficient length to form an adjustable loop encircling the wearer's ankle with the ends of these portions connected by means of a one-piece buckle 9 providing adjustment of the size of the ankle loop. The buckle is secured to one of the end portions of strap 10 and has transverse slots for receiving and frictionally and adjustably holding the other end of the strap 10. A suitable buckle well known for fastening the ends of straps is available commercially under the name "Fastex" from a source in Des Plaines, Ill.

The end portions 10 of the rear retention strap 12 are small loops through which the ankle-encircling portion of the main strap passes at opposite sides of the heel of the wearer to control the height of the ankle-encircling loop above the sole of the sandal and to aid in holding the wearer's heel transversely with respect to the sandal sole assembly. The ends of the strap 12 are doubled back and stitched together to form these small loops.

Both retention straps are approximately one inch wide and approximately 0.045 inches in thickness. The strap material is polypropylene which is desirable because of its resistance to stretching. The slots 5 and 6 are just large enough to allow the straps 11 and 12 to be easily passed therethrough during assembly.

As seen most clearly in FIG. 5, the paper adhesive barrier 8 does not completely cover the portions of strap 11 which lie crossed below the midsole 2. However, a sufficient area of these crossed portions is covered to form an adhesive barrier to reduce the adhesion of these strap portions to either the midsole 2 or the lower sole 1 at least during assembly and initial adjustment of the strap 11 to fit the foot of an individual wearer. As mentioned previously the adhesion will increase after an initial wear-in period and take a "set" which will keep the strap adjusted during subsequent wear even under the mentioned rigorous hiking conditions. The paper barrier may disintegrate due to wear or a few repeated adjustments, particularly when the sandal is immersed to allow water to penetrate along the strap 11 to the location of the paper barrier 8 and weaken the bonds among the paper fibers.

Figure 7:
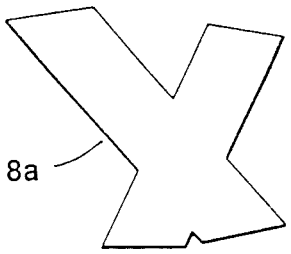
FIG. 7 shows an alternative embodiment of the adhesive barrier of FIG. 4.

An alternative embodiment of the invention may use flat precut pieces of plastic film **8*a*, as seen in FIG. 7, above and below the crossed portions of the strap 12 to form an adhesive barrier. This film may even be thinner than the thickness of the paper barrier. It may be perforated or have some degree of porosity and the possible penetration of the adhesive should be considered along with the coefficient of friction with respect to the strap material to provide a desired amount of residual slidability of the strap portions or a residual resistance to slidability as desired. A thin film of plastic available under the name "Mylar" would provide a very strong adhesive barrier. A thin film of "Teflon" polytetrafluoroethylene plastic would have a very low coefficient of friction to facilitate residual adjustment even after a break-in period. Such precut plastic films may have the ends of the X-shape shortened to provide a selected amount of direct exposure of portions of the strap 11 to the adhesive as occurs beyond the area of the paper barrier 8 as seen in FIG. 5. Such an X-shape similar to that shown in FIG. 7, shortened, but otherwise corresponding to the shape formed by the crossed strap portions, may be located overlying the strap portions, between them and the adjacent sole lamination so that the strongest adhesive bonding between either adjacent sole lamination 1 or 2 and the crossed strap portions 11 occurs only at portions of the latter which are adjacent to slots 5. These films can be made to partially wrap around the strap 11 to hold them in position or their irregular configuration may permit them to be held in place by the areas of adhesive bonding of the midsole 2 to the lower sole 1** around the periphery of the precut plastic film.

In either the preferred or alternate embodiments of the adhesive barrier, varying the size of the barrier means used in relation to the strap portions which pass through the sole assembly A allows control of the location of any bonding by the adhesive which takes place between the lower sole 1, mid-sole 2 and retention strap 11. Such bonding can be limited to portions of the strap adjacent to slots 5, thereby insuring that such bonds can be more readily broken by application of a pulling force to the strap once the sandal is assembled.

Once the adhesive barrier 8 is in place around the strap 11, the arch support 4 and lower 1 sole are adhered to the assembly made up of the retention straps 6 and 11, the upper sole and midsole. The arch support of a type made from a dense foam rubber and is commercially available from the Silverite Gutterman Co. of Boston, Mass. 02119.

The foregoing embodiments are capable of attaining various objects and features of the invention but are not intended to limit the invention beyond what is defined in the appended claims.

What is claimed is:

1. A sandal comprising at least two laminations forming the upper and lower portions of the sandal, the upper lamination having a plurality of apertures therein, foot retention strap means having a plurality of first strap portions passing through the apertures, the strap means having a plurality of second portions extending transversely of the sandal between the laminations and with each of said second portions interconnecting two of said first strap portions, the strap means having parts above the upper lamination for attaching the sandal to a foot, said parts forming at least one loop from one of said apertures to another of said apertures and being manually engageable to pull said second portions relative to the upper lamination to adjust the size of each such loop, an adhesive between said laminations over essentially all the opposed surfaces of the laminations for securing the laminations to each other except where portions of the strap means lie therebetween, thin material adjacent opposite surfaces of at least part of said second portions of the strap means to prevent contact of the adhesive therewith wherever said material overlies said strap portions, said material being sufficiently thin to prevent any perception by the wearer of increased thickness of the sandal sole in the areas of said second transversely extending portions of the strap means and to allow said last mentioned portions to slide between the laminations as said strap parts are pulled to adjust the size of a respective loop.

2. A sandal according to claim 1 wherein said material is made of a sheet of the order of 0.002 inches in thickness.

3. A sandal according to claim 1 wherein said material is paper.

4. A sandal according to claim 1 wherein said material is a porous sheet to allow some adhesive to penetrate the material and permit a reduced amount of adhesion between the strap means and the sole laminations.

5. A sandal according to claim 1 wherein two of said second portions of the strap means cross each other in the area of the sandal which supports the ball of the foot.

6. A sandal according to claim 5 wherein said sheet material generally conforms to the configuration of the crossed second portions of the strap means.

7. A sandal according to claim 1 wherein said adhesive is capable of readhering the strap to the adjacent laminations after partial loosening of the strap during use or adjustment.

8. A sandal according to claim 1 wherein said material is a plastic film having a low coefficient of friction with respect to the material of the strap means.

9. A sandal according to claim 8 wherein said plastic film overlies less than the entire surface of said crossed strap portions so that adhesive bonding between the lower or upper lamination and said crossed strap portions occurs primarily at portions of said crossed straps which are adjacent to said apertures.

10. A sandal comprising a sole having a plurality of laminations, an upper one of said laminations having two perforations at a forward part of the sole and two perforations near the center of the sole, said perforations defining a quadrilateral enclosing a principal weight-supporting area of the sole, a strap forming a toe loop to cross over a forward portion of the wearer's foot near the base of the toes with the ends of the loop extending down through respective ones of said perforations at the forward part of the sandal, said ends having portions crossing each other between adjacent laminations of the sole near said weight-supporting area and then extending upwardly at opposite sides of the sandal through the other respective perforations at the center of the sandal, the upwardly extending strap ends having sufficient length to cross each other again above the wearer's instep and having means for connecting the ends to form a loop encircling the wearer's ankle to secure the sandal to the foot, an adhesive between said adjacent laminations for bonding them together, the crossed portions of the strap between the laminations having surface portions facing said adhesive, thin barrier means adjacent said surface portions to at least partially prevent said adhesive from fixedly bonding said surface portions to the lamination portions which they face at least during initial assembly of the sandal to permit sliding adjustment of at least one of said last mentioned crossed portions to vary the size of the toe loop to fit an individual wearer's foot, the connecting means providing further adjustment of the size of the loop encircling the ankle for proper fit of the sandal to that individual wearer, said barrier means providing no perceptible increase in the thickness of the sole at the area of the crossed straps between the adjacent laminations.

11. A sandal according to claim 10 wherein said adhesive covers both of said adjacent laminations throughout and beyond the area of said crossed strap portions which are between these laminations, and said thin barrier means at least partially covers both faces of both of these last mentioned crossed strap ends.

12. A sandal according to claim 10 wherein said barrier means is a material that is partially penetrable by the adhesive.

13. A sandal according to claim 10 wherein said barrier means is a material which has reduced effectiveness after a wearing-in period whereby the adhesive more securely retains the toe loop in its adjusted size.

14. A sandal according to claim 10 wherein said barrier means is a thin sheet of tissue paper wrapped around the crossed strap portions between the adjacent laminations.

15. A sandal according to claim 10 wherein said barrier means is not more than 0.002 inches in thickness at any strap surface.

16. A sandal according to claim 10 wherein said barrier means at least partially disintegrates after a wearing-in period.

17. A sandal according to claim 10 wherein said barrier means comprises a film of plastic material on at least one side of the crossed strap portions between the adjacent laminations.

18. A sandal according to claim 17 wherein said adhesive barrier film comprises a smaller surface area than that of said crossed strap portions so located that the strongest adhesive bonding between said adjacent laminations and said crossed strap portions occurs only at portions of the latter which are adjacent said perforations.

19. A sandal according to claim 10 wherein said barrier means is a thin film of plastic facilitating continued adjustment of the size of the toe loop during an extended period of wear of the sandal.

20. A sandal according to claim 10 wherein a further strap is secured to the sole at each side of the heel, each said further strap having a loop at its upper end to receive therethrough the ankle loop at the respective side of the sandal.

* * * * *